US011554309B2

(12) United States Patent
Turkbas

(10) Patent No.: US 11,554,309 B2
(45) **Date of Patent: *Jan. 17, 2023**

(54) MOUTHGUARD INCLUDING BREATHING CHANNELS

(71) Applicant: Shock Doctor, Inc., Fountain Valley, CA (US)

(72) Inventor: Jay N. Turkbas, Hideout, UT (US)

(73) Assignee: SHOCK DOCTOR, INC., Fountain Valley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/450,310

(22) Filed: Oct. 8, 2021

(65) Prior Publication Data

US 2022/0023740 A1 Jan. 27, 2022

Related U.S. Application Data

(63) Continuation of application No. 16/034,669, filed on Jul. 13, 2018, now Pat. No. 11,141,646.

(60) Provisional application No. 62/532,608, filed on Jul. 14, 2017.

(51) Int. Cl.
*A63B 71/08* (2006.01)

(52) U.S. Cl.
CPC ..... *A63B 71/085* (2013.01); *A63B 2071/086* (2013.01); *A63B 2071/088* (2013.01)

(58) Field of Classification Search
CPC ..... A63B 71/085; A63B 2071/086; A63B 2071/088; A61F 5/566; A61F 5/56; A61F 2005/563; A61C 5/90; A61C 7/06; A61C 7/08; Y10S 602/902
USPC ..... 128/848, 859, 860, 861, 862
See application file for complete search history.

(56) References Cited

U.S. PATENT DOCUMENTS

| | | | | |
|---|---|---|---|---|
| 2,521,039 | A | 9/1950 | Carpenter | |
| 7,549,423 | B1 * | 6/2009 | Hirshberg | A63B 71/085 128/862 |
| 11,141,646 | B2 | 10/2021 | Turkbas | |
| 2015/0209645 | A1 * | 7/2015 | Zents | A63B 71/085 128/861 |

* cited by examiner

*Primary Examiner* — Erin Deery
*Assistant Examiner* — Robin Han
(74) *Attorney, Agent, or Firm* — Faegre Drinker Biddle & Reath LLP

(57) ABSTRACT

A mouthguard according to an embodiment of the present disclosure includes a teeth engagement portion having a medial surface. An anterior surface is coupled to the teeth engagement portion opposite the medial surface. A first breathing channel extends from the anterior surface to the medial surface. A second breathing channel extends from the anterior surface to the medial surface. A third breathing channel extends from the anterior surface to the medial surface. A first interior wall is disposed between the first breathing channel and the second breathing channel. The first interior wall is configured to be aligned with a first upper incisor of a wearer. A second interior wall is disposed between the second breathing channel and the third breathing channel. The second interior wall is configured to be aligned with a second upper incisor of the wearer.

2 Claims, 12 Drawing Sheets

MOUTHGUARD INCLUDING BREATHING CHANNELS

CROSS-REFERENCE TO RELATED APPLICATION

The present application is a continuation of U.S. application Ser. No. 16/034,669, filed Jul. 13, 2018, issued as U.S. Pat. No. 11,141,646 on Oct. 12, 2021, which claims the benefit of and priority, under 35 U.S.C. § 119(e), to U.S. Provisional Application No. 62/532,608, filed Jul. 14, 2017, which are hereby incorporated by reference in their entireties.

TECHNICAL FIELD

The present invention relates to mouthguards for protecting a wearer's mouth during physical activities. More specifically, the present invention relates to mouthguards that include breathing channels.

BACKGROUND

Mouthguards are typically used to protect a wearer's teeth, oral tissue, and gums from impact and abrasion. Mouthguards may reduce the chance of shock and other injuries resulting from impacts during athletic activities. Some mouthguards include breathing channels to facilitate breathing therethrough.

SUMMARY

In a first example, a mouthguard according to the present disclosure includes a teeth engagement portion having a medial surface. An anterior surface is coupled to the teeth engagement portion opposite the medial surface. A first breathing channel extends from the anterior surface to the medial surface. A second breathing channel extends from the anterior surface to the medial surface. A third breathing channel extends from the anterior surface to the medial surface. A first interior wall is disposed between the first breathing channel and the second breathing channel. The first interior wall is configured to be aligned with a first upper incisor and disposed between the first upper incisor and a first lower incisor of a wearer. A second interior wall is disposed between the second breathing channel and the third breathing channel. The second interior wall is configured to be aligned with a second upper incisor and disposed between the second upper incisor and a second lower incisor of the wearer.

In a second example, the mouthguard of the first example further includes a front lip protection portion coupled to the teeth engagement portion, and the front lip protection portion includes the anterior surface.

In a third example, the mouthguard of the second example further includes a lip engagement portion coupling the front lip protection portion to the teeth engagement portion.

In a fourth example, each of the first breathing channel, the second breathing channel, and the third breathing channel of any of the preceding examples includes an anterior opening formed on the anterior surface, a posterior opening formed on the medial surface, and an intermediate opening disposed between the anterior surface and the medial surface.

In a fifth example, wherein the lip engagement portion of the fourth example includes a posterior surface, and the intermediate opening is formed on the posterior surface.

In a sixth example, a mouthguard according to the present disclosure includes a teeth engagement portion including a medial surface. An anterior surface is coupled to the teeth engagement portion opposite the medial surface. A first breathing channel extends from the anterior surface to the medial surface. A second breathing channel extends from the anterior surface to the medial surface. A third breathing channel extends from the anterior surface to the medial surface. A first interior wall is disposed between the first breathing channel and the second breathing channel. A second interior wall is disposed between the second breathing channel and the third breathing channel. The second interior wall and the first interior wall are disposed apart by a distance of 0.46 in. to 0.26 in. in a horizontal direction.

In a seventh example, the mouthguard of the sixth example further includes a front lip protection portion coupled to the teeth engagement portion, the front lip protection portion including the anterior surface.

In an eighth example, the mouthguard of the seventh example further includes a lip engagement portion coupling the front lip protection portion to the teeth engagement portion.

In a ninth example, each of the first breathing channel, the second breathing channel, and the third breathing channel of any of the sixth, seventh, or eighth examples include an anterior opening formed on the anterior surface, a posterior opening formed on the medial surface, and an intermediate opening disposed between the anterior surface and the medial surface.

In a tenth example, the lip engagement portion of the ninth example includes a posterior surface, and the intermediate opening is formed on the posterior surface.

In an eleventh example, the mouthguard of any of the preceding examples further includes a flange including the anterior surface, and a lip engagement portion coupling the flange to the teeth engagement portion.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
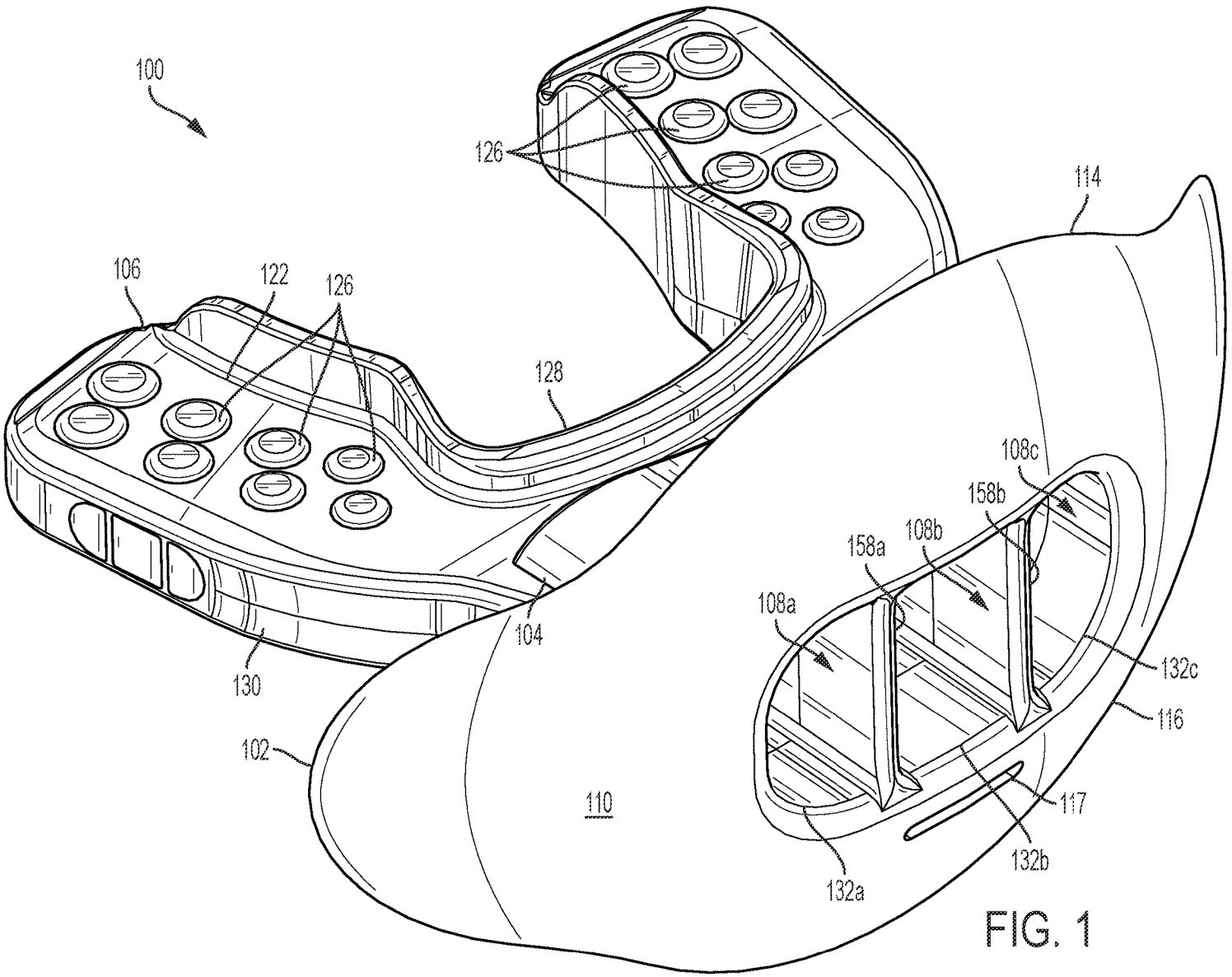
FIG. 1 is a front perspective view of a mouthguard, according to some embodiments.

It should be understood that the drawings are intended facilitate understanding of exemplary embodiments of the present invention are not necessarily to scale.

DETAILED DESCRIPTION

The following description refers to the accompanying drawings which show specific embodiments. Although specific embodiments are shown and described, it is to be understood that additional or alternative features are employed in other embodiments. The following detailed description is not to be taken in a limiting sense, and the scope of the claimed invention is defined by the appended claims and their equivalents.

It should be understood that like reference numerals are intended to identify the same structural components, elements, portions, or surfaces consistently throughout the several drawing figures, as such components, elements, portions, or surfaces may be further described or explained by the entire written specification, of which this detailed description is an integral part. Unless otherwise indicated, the drawings are intended to be read (for example, cross-hatching, arrangement of parts, proportion, degree, etc.) together with the specification, and are to be considered a portion of the written description. In the description, the terms "superior", "inferior", "anterior", "posterior", "medial", "lateral", and "horizontal" as well as variations thereof (for example, "superiorly" and the like) are used to describe relative positions of features of mouthguards. Such terms refer to anatomical reference directions when a mouthguard is positioned in a wearer's mouth in a typical orientation. Specifically, "superior" refers to a direction extending from the feet toward the head, "inferior" refers to a direction extending from the head toward the feet, "anterior" refers to a direction extending from the back of the head to the eyes, "posterior" refers to a direction extending from the eyes to the back of the head, "medial" refers to directions extending from the right shoulder to the base of the neck or from the left shoulder to the base of the neck, and "lateral" refers to directions extending from the base of the neck toward the right shoulder or from the base of the neck to the left shoulder. Additionally, a "sagittal plane" refers to a plane extending in a superior/inferior direction and bisecting a mouthguard.

FIGS. 1-8 illustrate a mouthguard 100, according to some embodiments. Generally, the mouthguard 100 includes a front lip protection portion 102, a lip engagement portion 104, and a teeth engagement portion 106. The mouthguard 100 also includes a plurality of breathing channels (for example and as shown, three breathing channels 108*a*, 108*b*, and 108*c*) that extend through the front lip protection portion 102, the lip engagement portion 104, and the teeth engagement portion 106.

The front lip protection portion 102 has various possible heights and sizes, and may be relatively large to help provide additional protection to the soft tissues surrounding the mouth. For example, the front lip protection portion 102 is configured or otherwise sized and shaped to entirely cover a lip or both lips of the wearer. In some embodiments, the front lip protection portion 102 includes an anterior surface 110 (see FIGS. 1 and 2) facing away from the teeth of the wearer and an interior surface 112 (see FIG. 3) facing toward the teeth of the wearer. In some embodiments, the front lip protection portion 102 includes an upper lip protection segment 114, also described as an upper lip section or portion, and a lower lip protection segment 116, also described as a lower lip section or portion. Although as shown the front lip protection portion 102 includes both protection segments, in other embodiments the front lip protection portion 102 includes one of the protection segments. The upper lip protection segment 114 is configured to protect the upper lip of the mouth from impact. Similarly, the lower lip protection segment 116 is configured to protect the lower lip of the mouth.

As shown, the lower lip protection segment 116 includes a slot 117 for receiving a tether (not shown). In other embodiments, the slot 117 may be omitted.

The lip engagement portion 104 is posterior to the front lip protection portion 102. In some embodiments and as shown, the lip engagement portion 104 may be relatively small compared to the front lip protection portion 102. More specifically, the lip engagement portion 104 may be smaller than the front lip protection portion 102 in a superior/inferior direction and a horizontal direction. The lip engagement portion 104 includes posterior surfaces opposite the front lip protection portion 102. Specifically, the lip engagement portion 104 includes a superior posterior surface 118 and an inferior posterior surface 120.

The teeth engagement portion 106 is posterior to the lip engagement portion 104. In some embodiments, one or both of a superior surface 122 and an inferior surface 124 of the teeth engagement portion 106 includes structural features to facilitate engagement with the wearer's teeth, such as a plurality of protrusions 126 as shown. The teeth engagement portion 106 further includes a medial, or inner, surface 128 and a lateral, or outer, surface 130. The medial surface 128 generally faces toward the tongue of the wearer and the lateral surface 130 generally faces toward the inner surfaces of the wearer's cheeks.

As briefly described above, the mouthguard 100 includes a plurality of breathing channels (for example and as shown in the figures, three breathing channels 108*a*, 108*b*, and 108*c*) in order to help the wearer to breathe easily, even when the wearer's teeth are clenching down on the mouthguard 100 or when the wearer's lips form a seal with the mouthguard 100 around the lip engagement portion 104, for example. The breathing channels 108*a*, 108*b*, and 108*c* include anterior openings 132*a*, 132*b*, and 132*c*, respectively, formed on the anterior surface 110 of the front lip protection portion 102, which may be in an area of the anterior surface 110 between, or at the joining of, the upper lip protection segment 114 and lower lip protection segment 116. The breathing channels 108*a*, 108*b*, and 108*c* extend from the anterior openings 132*a*, 132*b*, and 132*c*, respectively, to posterior openings 134*a*, 134*b*, and 134*c*, respectively, formed on the medial surface 128 of the teeth engagement portion 106. The breathing channels 108*a*, 108*b*, and 108*c* also include superior intermediate openings 136*a*, 136*b*, and 136*c*, respectively, and inferior intermediate openings 138*a*, 138*b*, and 138*c*, respectively, formed on the superior posterior surface 118 and the inferior posterior surface 120, respectively, of the lip engagement portion 104. Stated another way, the breathing channels 108*a*, 108*b*, and 108*c* include superior intermediate openings 136*a*, 136*b*, and 136*c*, respectively, and inferior intermediate openings 138*a*, 138*b*, and 138*c*, respectively, that are disposed between, in an anterior/posterior direction, the anterior openings 132*a*, 132*b*, and 132*c*, respectively, and the posterior openings 134*a*, 134*b*, and 134*c*, respectively.

Figure 2:
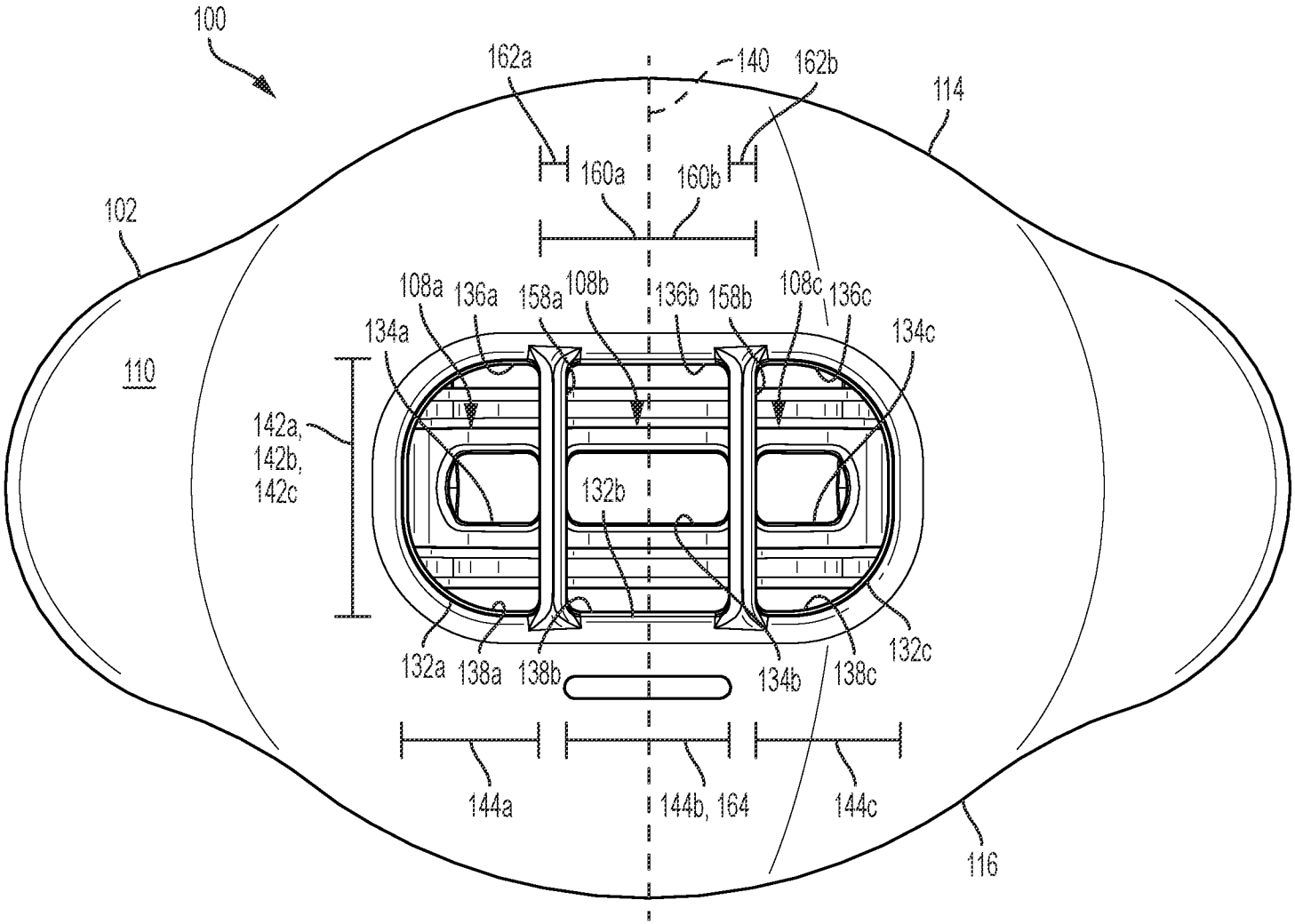
FIG. 2 is a front view of the mouthguard of FIG. 1, according to some embodiments.
Figure 3:
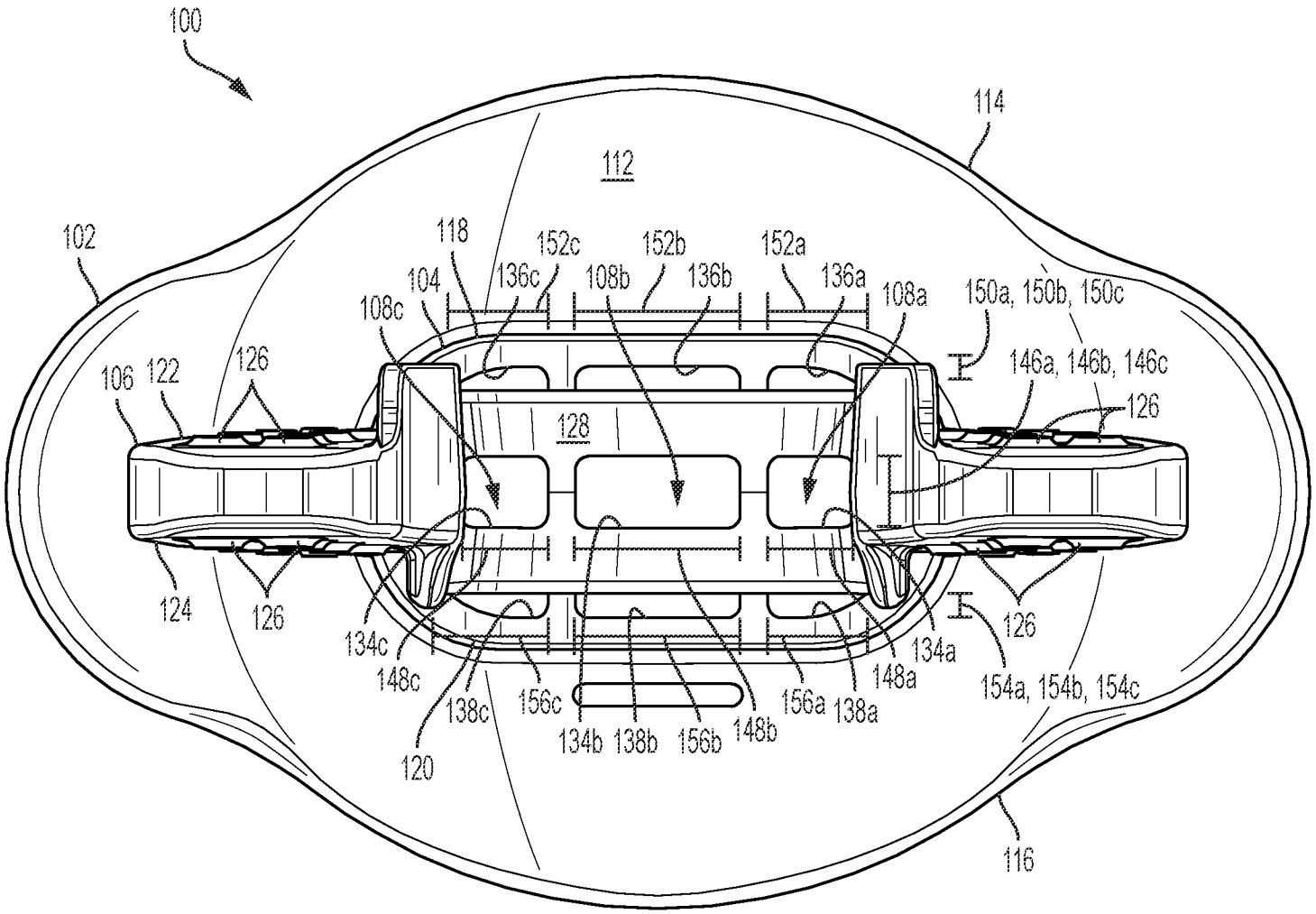
FIG. 3 is a back view of the mouthguard of FIG. 1, according to some embodiments.
Figure 4:
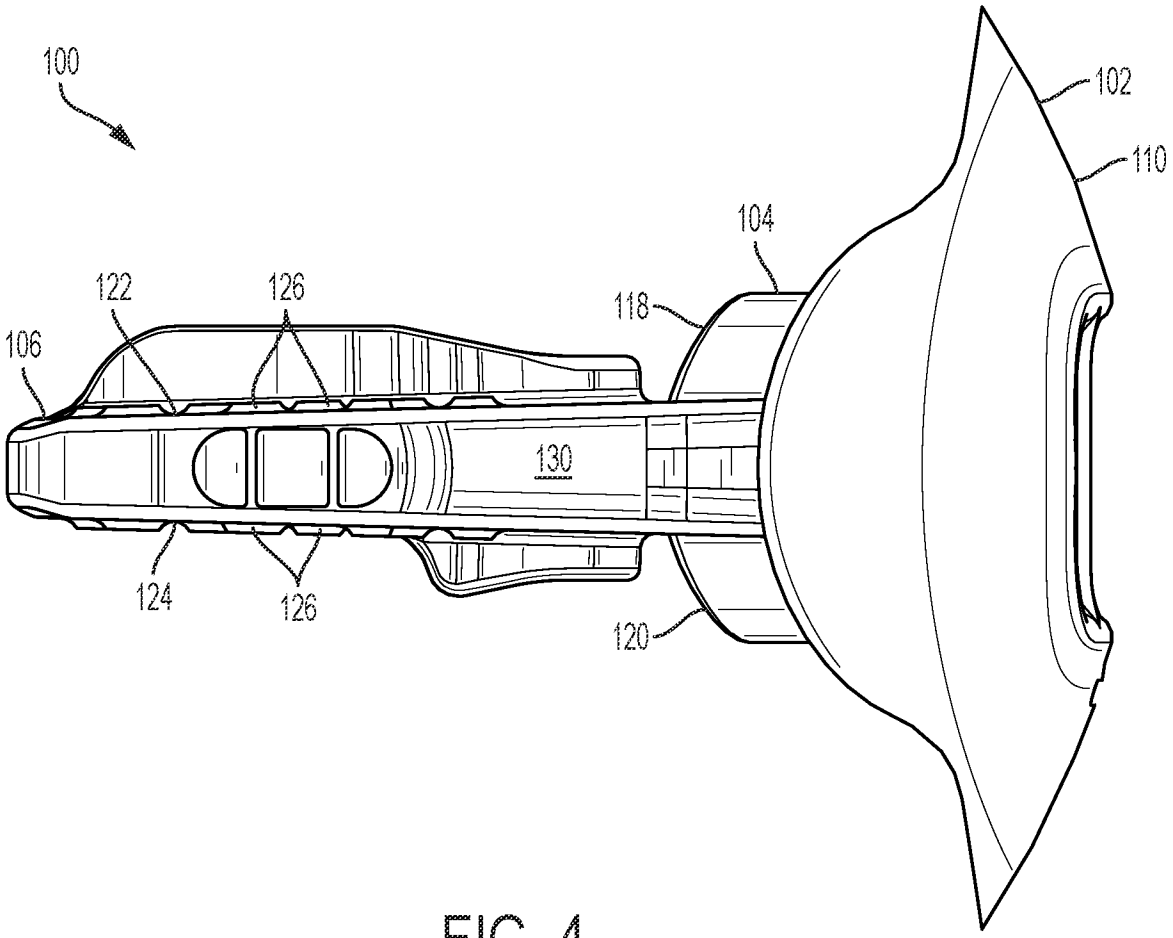
FIG. 4 is a left side view of the mouthguard of FIG. 1, according to some embodiments.
Figure 5:
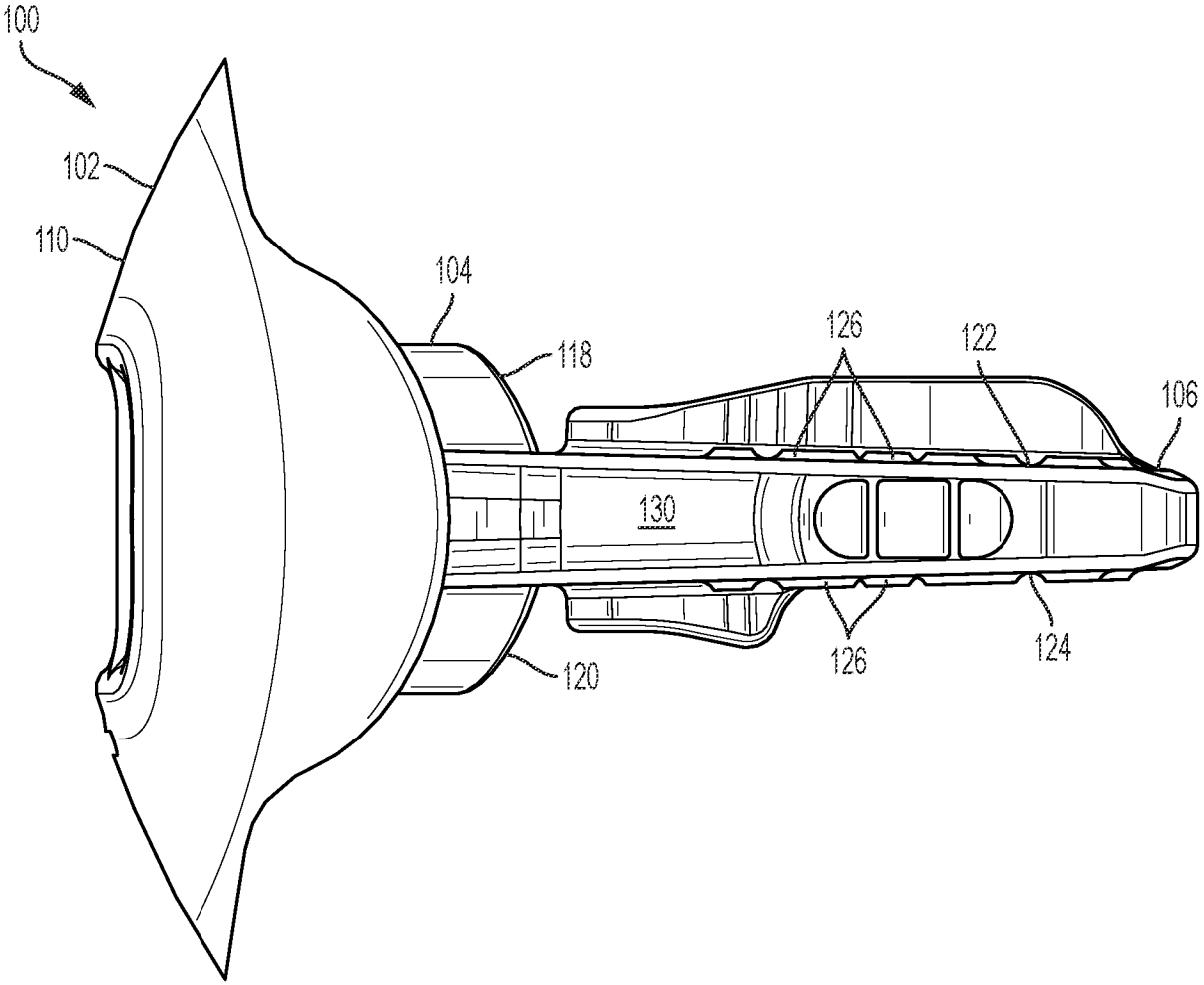
FIG. 5 is a right side view of the mouthguard of FIG. 1, according to some embodiments.
Figure 6A:
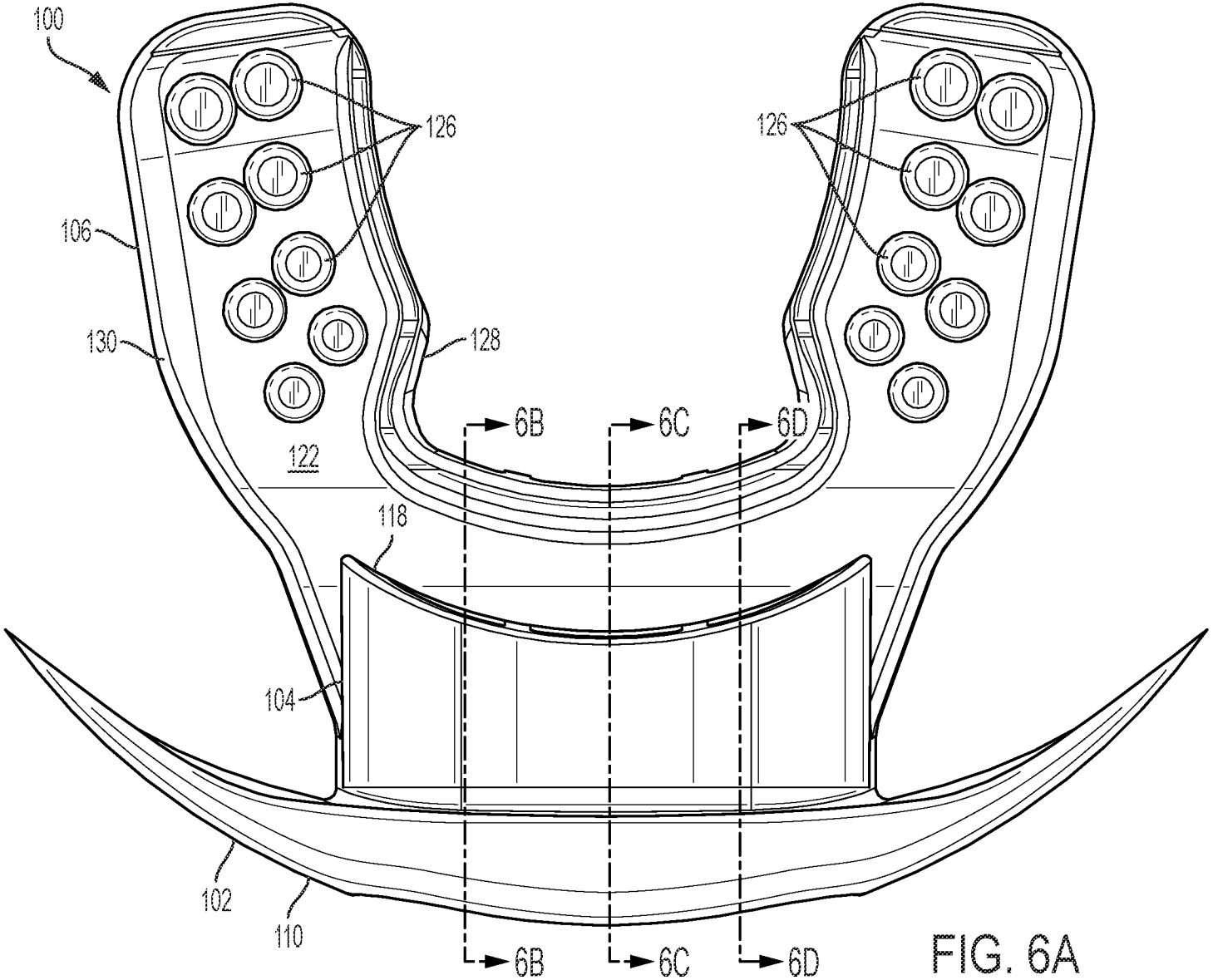
FIG. 6A is a top view of the mouthguard of FIG. 1, according to some embodiments.
Figure 6B:
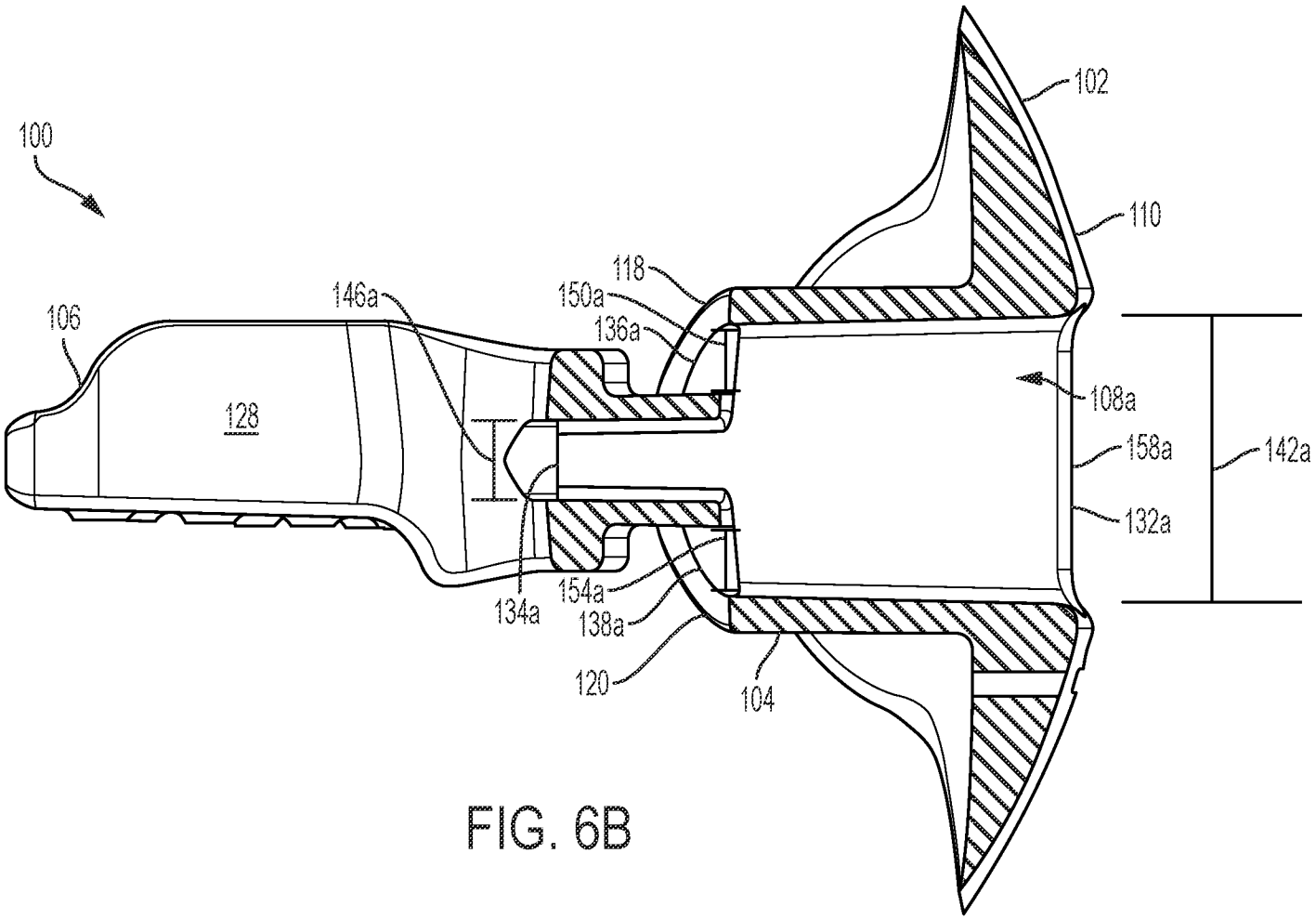
FIG. 6B is a side sectional view of the mouthguard of FIG. 1 along line 6B-6B of FIG. 6A, according to some embodiments.

Referring specifically to FIGS. 2, 3, and 6B, the first breathing channel 108*a* is disposed to a first side of the sagittal plane 140 (see FIG. 2) of the mouthguard 100. The first breathing channel 108*a* may have a rectangular shape with two curved corners (disposed opposite the sagittal plane 140) as viewed in an anterior/posterior direction (that is, as shown in FIG. 2). The first anterior opening 132*a* may have a height 142*a* (that is, a dimension extending in a superior/inferior direction) of 0.75 in. to 0.45 in., more specifically 0.70 in. to 0.50 in., and even more specifically 0.65 in. to 0.55 in. The first anterior opening 132*a* may have a width 144*a* (that is, a dimension extending in a horizontal direction) of 0.45 in. to 0.15 in., more specifically 0.40 in. to 0.20 in., and even more specifically 0.35 in. to 0.25 in. The first posterior opening 134*a* may have a height 146*a* of 0.26 in. to 0.06 in., more specifically 0.23 in. to 0.09 in., and even more specifically 0.21 in. to 0.11 in. The first posterior opening 134*a* may have a width 148*a* of 0.33 in. to 0.13 in., more specifically 0.30 in. to 0.16 in., and even more specifically 0.28 in. to 0.18 in. The first superior intermediate opening 136*a* may have a height 150*a* of 0.24 in. to 0.04 in., more specifically 0.21 in. to 0.07 in., and even more specifically 0.19 in. to 0.09 in. The first superior intermediate opening 136*a* may have a width 152*a* of 0.34 in. to 0.14 in., more specifically 0.31 in. to 0.17 in., and even more specifically 0.29 in. to 0.19 in. The first inferior intermediate opening 138*a* may have a height 154*a* of 0.24 in. to 0.04 in., more specifically 0.21 in. to 0.07 in., and even more specifically 0.19 in. to 0.09 in. The first inferior intermediate opening 138*a* may have a width 156*a* of 0.34 in. to 0.14 in., more specifically 0.31 in. to 0.17 in., and even more specifically 0.29 in. to 0.19 in. The first breathing channel 108*a* may taper inwardly proceeding from the anterior surface 110 toward the medial surface 128. The first breathing channel 108*a* may taper at an angle of 1.70 degrees to 0.70 degrees, more specifically 1.45 degrees to 0.95 degrees, and even more specifically 1.30 degrees to 1.10 degrees.

Figure 6C:
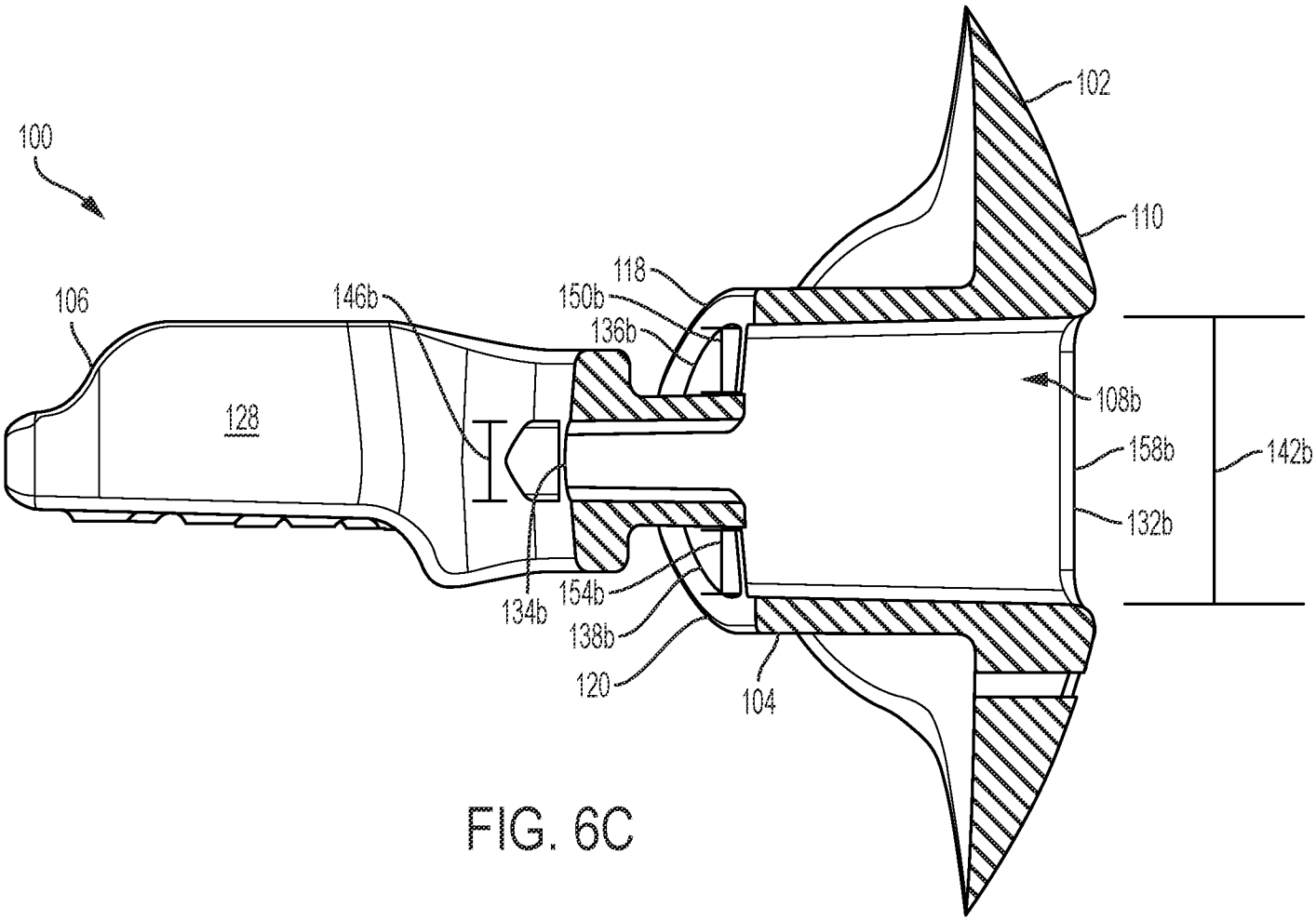
FIG. 6C is a side sectional view of the mouthguard of FIG. 1 along line 6C-6C of FIG. 6A, according to some embodiments.

Referring specifically to FIGS. 2, 3, and 6C, the second breathing channel 108*b* is bisected by the sagittal plane 140. The second breathing channel 108*b* may have a rectangular shape as viewed in an anterior/posterior direction (that is, as shown in FIG. 2). The second anterior opening 132*b* may have a height 142*b* of 0.75 in. to 0.45 in., more specifically 0.70 in. to 0.50 in., and even more specifically 0.65 in. to 0.55 in. The second anterior opening 132*b* may have a width 144*b* of 0.53 in. to 0.23 in., more specifically 0.48 in. to 0.28 in., and even more specifically 0.43 in. to 0.33 in. The second posterior opening 134*b* may have a height of 0.26 in. to 0.06 in., more specifically 0.23 in. to 0.09 in., and even more specifically 0.21 in. to 0.11 in. The second posterior opening 134*b* may have a width 148*b* of 0.53 in. to 0.23 in., more specifically 0.48 in. to 0.28 in., and even more specifically 0.43 in. to 0.33 in. The second superior intermediate opening 136*b* may have a height 150*b* of 0.24 in. to 0.04 in., more specifically 0.21 in. to 0.07 in., and even more specifically 0.19 in. to 0.09 in. The second superior intermediate opening 136*b* may have a width 152*b* of 0.53 in. to 0.23 in., more specifically 0.48 in. to 0.28 in., and even more specifically 0.43 in. to 0.33 in. The second inferior intermediate opening 138*b* may have a height 154*b* of 0.24 in. to 0.04 in., more specifically 0.21 in. to 0.07 in., and even more specifically 0.19 in. to 0.09 in. The second inferior intermediate opening 138*b* may have a width 156*b* of 0.53 in. to 0.23 in., more specifically 0.48 in. to 0.28 in., and even more specifically 0.43 in. to 0.33 in. The second breathing channel 108*b* may taper inwardly proceeding from the anterior surface 110 toward the medial surface 128. The second breathing channel 108*b* may taper at an angle of 1.70 degrees to 0.70 degrees, more specifically 1.45 degrees to 0.95 degrees, and even more specifically 1.30 degrees to 1.10 degrees.

Figure 6D:
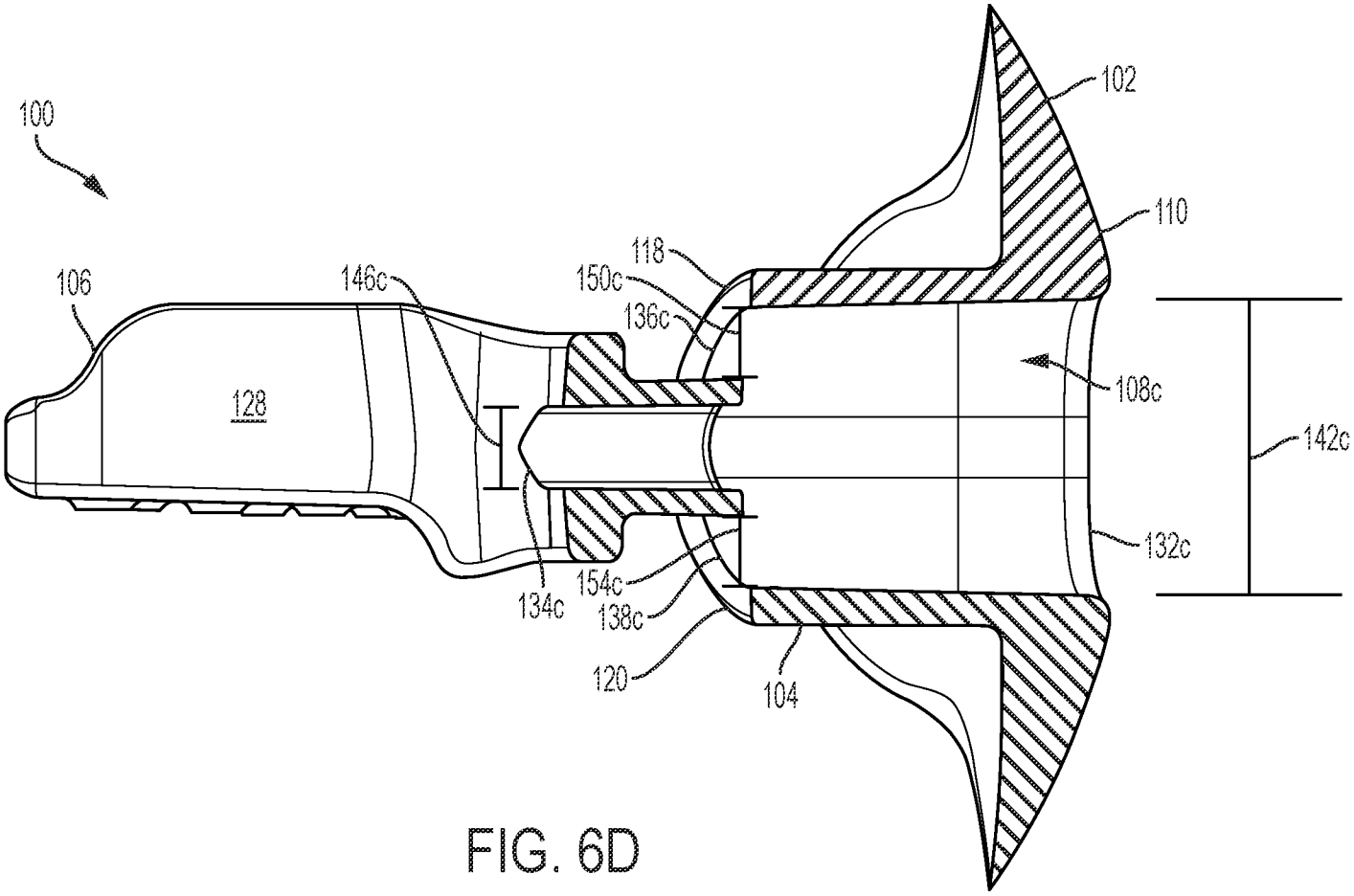
FIG. 6D is a side sectional view of the mouthguard of FIG. 1 along line 6D-6D of FIG. 6A, according to some embodiments.
Figure 7:
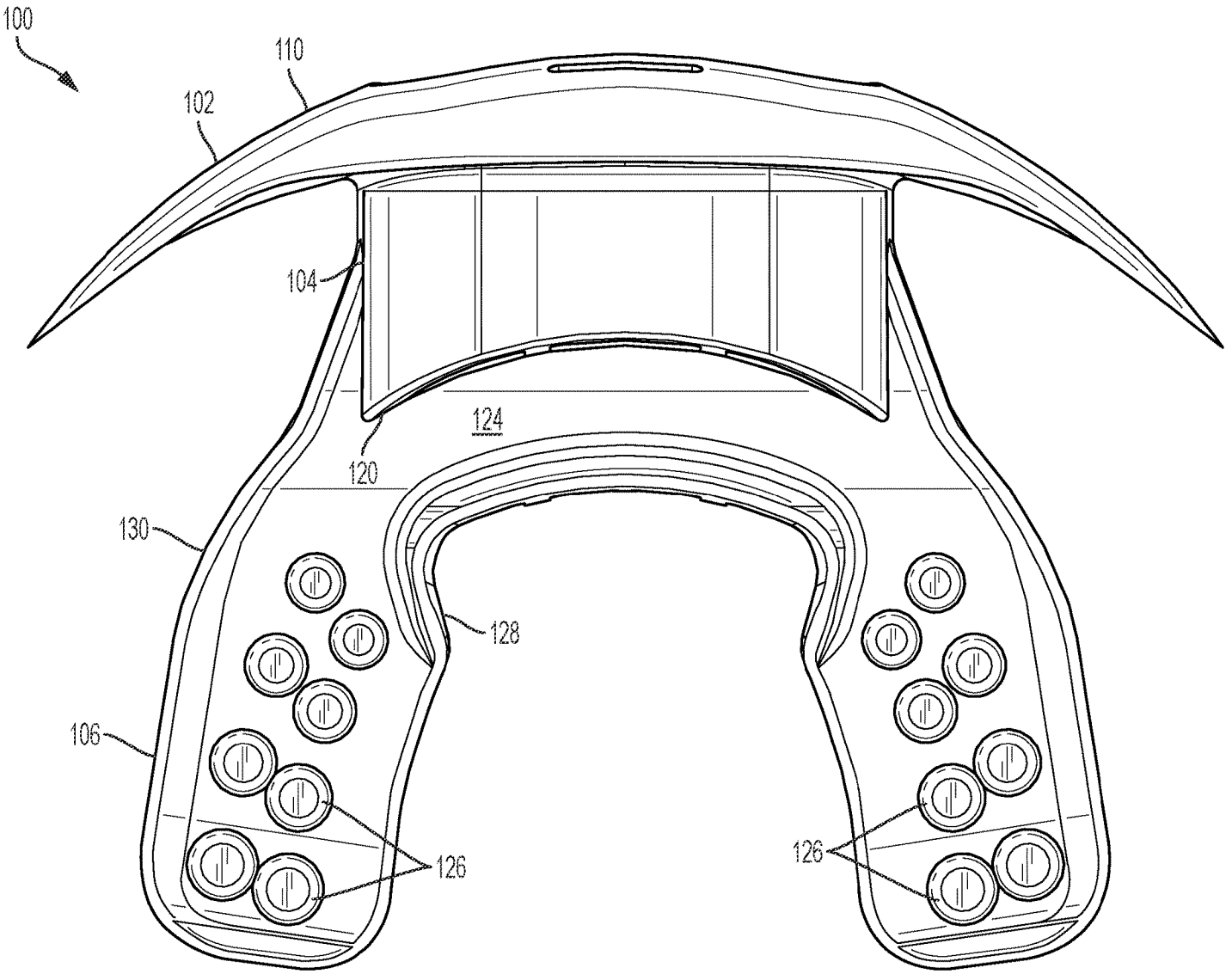
FIG. 7 is a bottom view of the mouthguard of FIG. 1, according to some embodiments.
Figure 8:
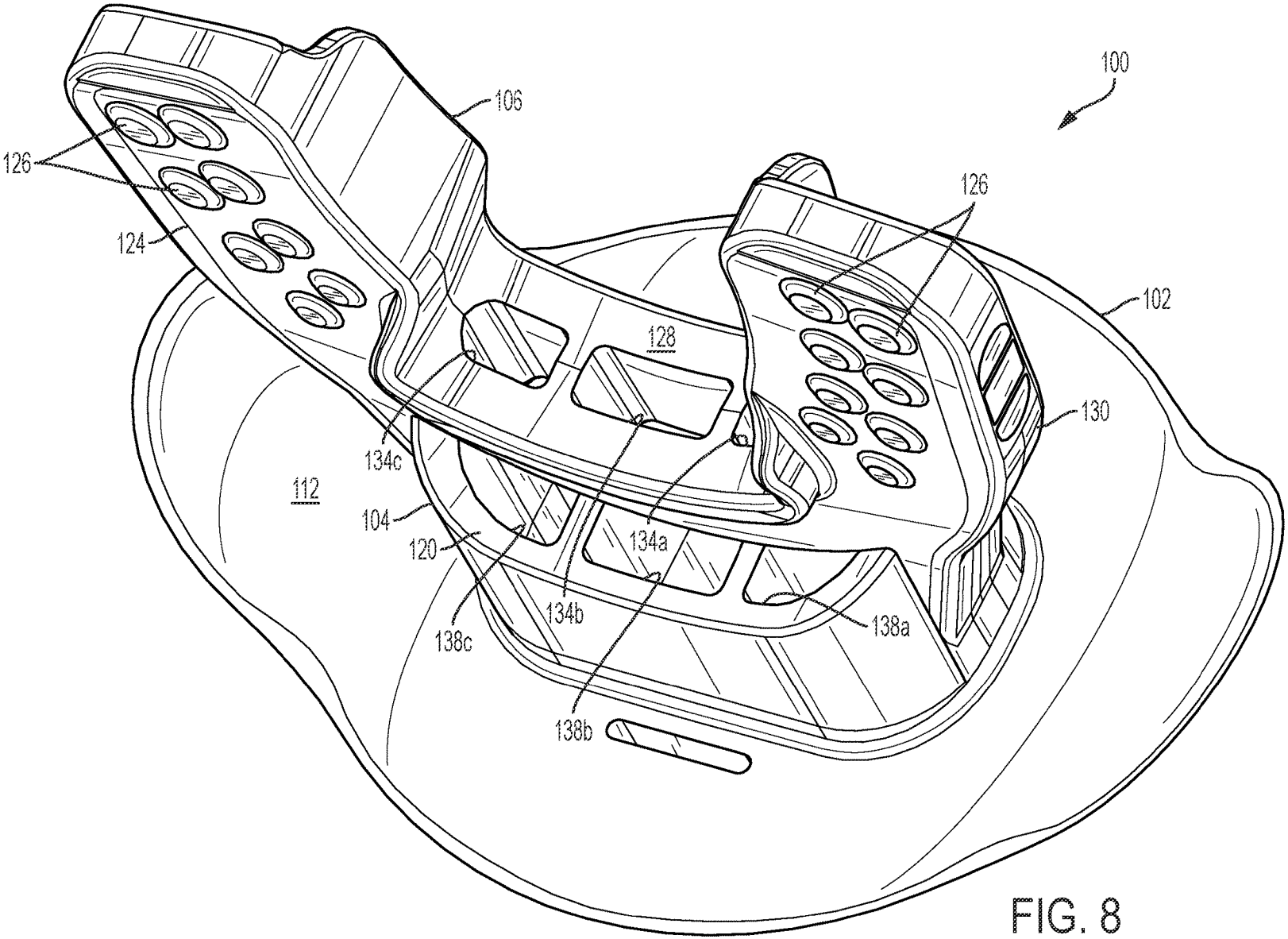
FIG. 8 is a rear perspective view of the mouthguard of FIG. 1, according to some embodiments.

Referring specifically to FIGS. 2, 3, and 6D, the third breathing channel 108*c* is disposed to a second side of the sagittal plane 140 of the mouthguard 100 opposite the first breathing channel 108*a*. The third breathing channel 108*c* may have a rectangular shape with two curved corners (disposed opposite the sagittal plane 140) as viewed in an anterior/posterior direction (that is, as shown in FIG. 2). The third anterior opening 132*c* may have a height 142*c* of 0.75 in. to 0.45 in., more specifically 0.70 in. to 0.50 in., and even more specifically 0.65 in. to 0.55 in. The third anterior opening 132*c* may have a width 144*c* of 0.45 in. to 0.15 in., more specifically 0.40 in. to 0.20 in., and even more specifically 0.35 in. to 0.25 in. The third posterior opening 134*c* may have a height of 0.26 in. to 0.06 in., more specifically 0.23 in. to 0.09 in., and even more specifically 0.21 in. to 0.11 in. The third posterior opening 134*c* may have a width 148*c* of 0.33 in. to 0.13 in., more specifically 0.30 in. to 0.16 in., and even more specifically 0.28 in. to 0.18 in. The third superior intermediate opening 136*c* may have a height 150*c* of 0.24 in. to 0.04 in., more specifically 0.21 in. to 0.07 in., and even more specifically 0.19 in. to 0.09 in. The third superior intermediate opening 136*c* may have a width 152*c* of 0.34 in. to 0.14 in., more specifically 0.31 in. to 0.17 in., and even more specifically 0.29 in. to 0.19 in. The third inferior intermediate opening 138*c* may have a height 154*c* of 0.24 in. to 0.04 in., more specifically 0.21 in. to 0.07 in., and even more specifically 0.19 in. to 0.09 in. The third inferior intermediate opening 138*c* may have a width 156*c* of 0.34 in. to 0.14 in., more specifically 0.31 in. to 0.17 in., and even more specifically 0.29 in. to 0.19 in. The third breathing channel 108*c* may taper inwardly proceeding from the anterior surface 110 toward the medial surface 128. The third breathing channel 108*c* may taper at an angle of 1.70 degrees to 0.70 degrees, more specifically 1.45 degrees to 0.95 degrees, and even more specifically 1.30 degrees to 1.10 degrees.

In some embodiments, the total size of the breathing channels 108*a*, 108*b*, and 108*c* is relatively large compared to other mouthguards. In some embodiments, the anterior openings 132*a*, 132*b*, and 132*c* may have a combined area of 0.77 in.$^2$ to 0.27 in.$^2$, more specifically 0.72 in.$^2$ to 0.32 in.$^2$, more specifically 0.67 in.$^2$ to 0.37 in.$^2$, and even more specifically 0.62 in.$^2$ to 0.42 in.$^2$.

Each of the breathing channels 108*a*, 108*b*, and 108*c* is separated from one or more adjacent breathing channels 108*a*, 108*b*, and 108*c* by an interior wall. More specifically, the mouthguard 100 includes one less interior wall than the number of breathing channels 108*a*, 108*b*, and 108*c* (for example and as shown, the mouthguard 100 includes two interior walls 158*a* and 158*b*).

Referring again to FIGS. 2, 3, and 6B, the first interior wall 158*a* is disposed between the first breathing channel 108*a* and the second breathing channel 108*b*. Stated another way, the first interior wall 158*a* separates the first breathing channel 108*a* from the second breathing channel 108*b* in a horizontal direction. In some embodiments, the first interior wall 158*a* extends continuously between the anterior surface 110 and the medial surface 128, besides terminating at the superior posterior surface 118 and the inferior posterior surface 120 of the lip engagement portion 104 (that is, at the intermediate openings). In some embodiments, the first interior wall 158*a* has a generally rectangular shape as viewed in an anterior/posterior direction. In some embodiments, the first interior wall 158*a* is positioned horizontally such that it is configured to be aligned with the right upper incisor (in a horizontal direction) and disposed between the right upper and lower incisors of the wearer. As such, the first interior wall 158*a* is configured to carry forces applied to the mouthguard 100 by the wearer's teeth and facilitate structural stability of the mouthguard 100. In some embodiments, the first interior wall 158*a* is disposed apart from the sagittal plane 140 by a horizontal distance 160*a* of 0.28 in. to 0.08 in., more specifically 0.25 in. to 0.11 in., and even more specifically 0.23 in. to 0.13 in. The horizontal distance 160*a* may be uniform in a superior/inferior direction and/or an anterior/posterior direction. In some embodiments, the first interior wall 158*a* has a thickness 162*a* in a horizontal direction of 0.09 in. to 0.03 in., more specifically 0.08 in. to 0.04 in., and even more specifically 0.07 in. to 0.05 in.

Referring again to FIGS. 2, 3, and 6C, the second interior wall 158*b* is disposed between the second breathing channel 108*b* and the third breathing channel 108*c*. Stated another way, the second interior wall 158*b* separates the second breathing channel 108*b* from the third breathing channel 108*c* in a horizontal direction. In some embodiments, the second interior wall 158*b* extends continuously between the anterior surface 110 and the medial surface 128, besides terminating at the superior posterior surface 118 and the inferior posterior surface 120 of the lip engagement portion 104 (that is, at the intermediate openings). In some embodiments, the second interior wall 158*b* has a generally rectangular shape as viewed in an anterior/posterior direction. In some embodiments, the second interior wall 158*b* is positioned horizontally such that it is configured to be aligned with the left upper incisor (in a horizontal direction) and disposed between the left upper and lower incisors of the wearer. As such, the second interior wall 158*b* is configured to carry forces applied to the mouthguard 100 by the wearer's teeth and facilitate structural stability of the mouthguard 100. In some embodiments, the second interior wall 158*b* is disposed apart from the sagittal plane 140 by a horizontal distance 160*b* of 0.28 in. to 0.08 in., more specifically 0.25 in. to 0.11 in., and even more specifically 0.23 in. to 0.13 in. The horizontal distance 160*b* may be uniform in a superior/inferior direction and/or an anterior/posterior direction. In some embodiments, the second interior wall 158*b* is disposed apart from first interior wall 158*a* by a horizontal distance 164 of 0.53 in. to 0.23 in., more specifically 0.48 in. to 0.28 in., and even more specifically 0.43 in. to 0.33 in. In some embodiments, the second interior wall 158*b* has a thickness 162*b* in a horizontal direction of 0.09 in. to 0.03 in., more specifically 0.08 in. to 0.04 in., and even more specifically 0.07 in. to 0.05 in.

In some embodiments, the interior walls 158*a* and 158*b* and the breathing channels 108*a*, 108*b*, and 108*c* advantageously facilitate enhanced support of the upper and lower incisors and distribution of biting forces imparted by the incisors across the width of the teeth engagement portion 106 and easy breathing through the mouthguard 100 compared to other mouthguards.

In some embodiments, the mouthguard 100 can include an opening configured to receive a tether (not shown), or the mouthguard 100 can be otherwise configured to couple to or include a tether. In any case, such a tether can be used by the wearer to couple the mouthguard 100 to a helmet.

In some embodiments, some portions of the mouthguard 100 are formed of a first material and other portions of the mouthguard 100 are formed of a second material that is different than the first material. More specifically, the front lip protection portion 102, a lateral surface 130 of the lip engagement portion 104, and the lateral surface 130 of the teeth engagement portion 106 are formed of a first material and the remainder of the lip engagement portion 104 and the teeth engagement portion 106 are formed of a second material that is different than the first material. In some embodiments, the first material has greater hardness than the second material. For example, the first material and the second material may be the same polymer or different polymers having different hardnesses. More specifically, the first material can be a low density thermoplastic rubber having a first durometer and the second material can be a low density thermoplastic rubber having a second durometer that is less than the first durometer. Examples of a first material include a thermoplastic rubber having a Shore A durometer of about 62. Examples of a second material include a thermoplastic rubber having a Shore A durometer of about 52 or less. In some embodiments, a ratio of the second durometer to the first durometer (that is, a value of the second durometer divided by a value of the first durometer) is about 90 percent or less is about 85 percent or less or is between 80 percent and 90 percent.

In some embodiments, the first material is a composite of a copolymer of ethylene and vinyl acetate (EVA), such as the Elvax™ resins commercially available from Ashland Chemical Company, and an elastomeric material such as thermoplastic rubber or vulcanized rubber. In some embodiments, the first material includes about 50 percent to about 80 percent by weight of the elastomeric material and about 20 percent to about 50 percent by weight of the copolymer of EVA. In some embodiments, the EVA copolymer can include vinyl acetate in the range of about 18 percent to about 28 percent by weight. In some embodiments, the first material is thermoplastic rubber marketed under the trademark KRATON™, which is marketed by GLS Plastics of 740B Industrial Drive, Cary, Ill. 60013. This thermoplastic rubber is unique in that it is injection moldable, FDA approved, and readily adheres with copolymers of EVA. Furthermore, the thermoplastic rubber has a melting or softening point significantly higher than that of EVA.

In various embodiments, the second material is 100 percent of a copolymer of ethylene and vinyl acetate, and has at least 33 percent of vinyl acetate by weight. In various embodiments, the second material includes a copolymer of ethylene and vinyl acetate, and has at least 40 percent of vinyl acetate by weight. For example, a suitable second material is a soft EVA 40. Alternatively, another suitable second material includes EVA 100. In some embodiments, the second material is a suitably soft thermoplastic rubber having a durometer low enough so that the mouthguard 100 does not have to be molded to the wearer's teeth. In some embodiments, the mouthguard 100 is a boil and bite mouthguard 100. For example, the mouthguard 100 is formed of one or more materials that soften at a temperature in the range of about 100 to about 150 degrees Fahrenheit, and the mouthguard 100 is molded to the wearer's teeth after raising the mouthguard 100 to such a temperature, for example, by immersing the mouthguard 100 in boiling water. In some embodiments, the mouthguard 100 is molded to the wearer's teeth at room temperature.

In some embodiments, the mouthguard 100 includes one or more flavorants.

Figure 9:
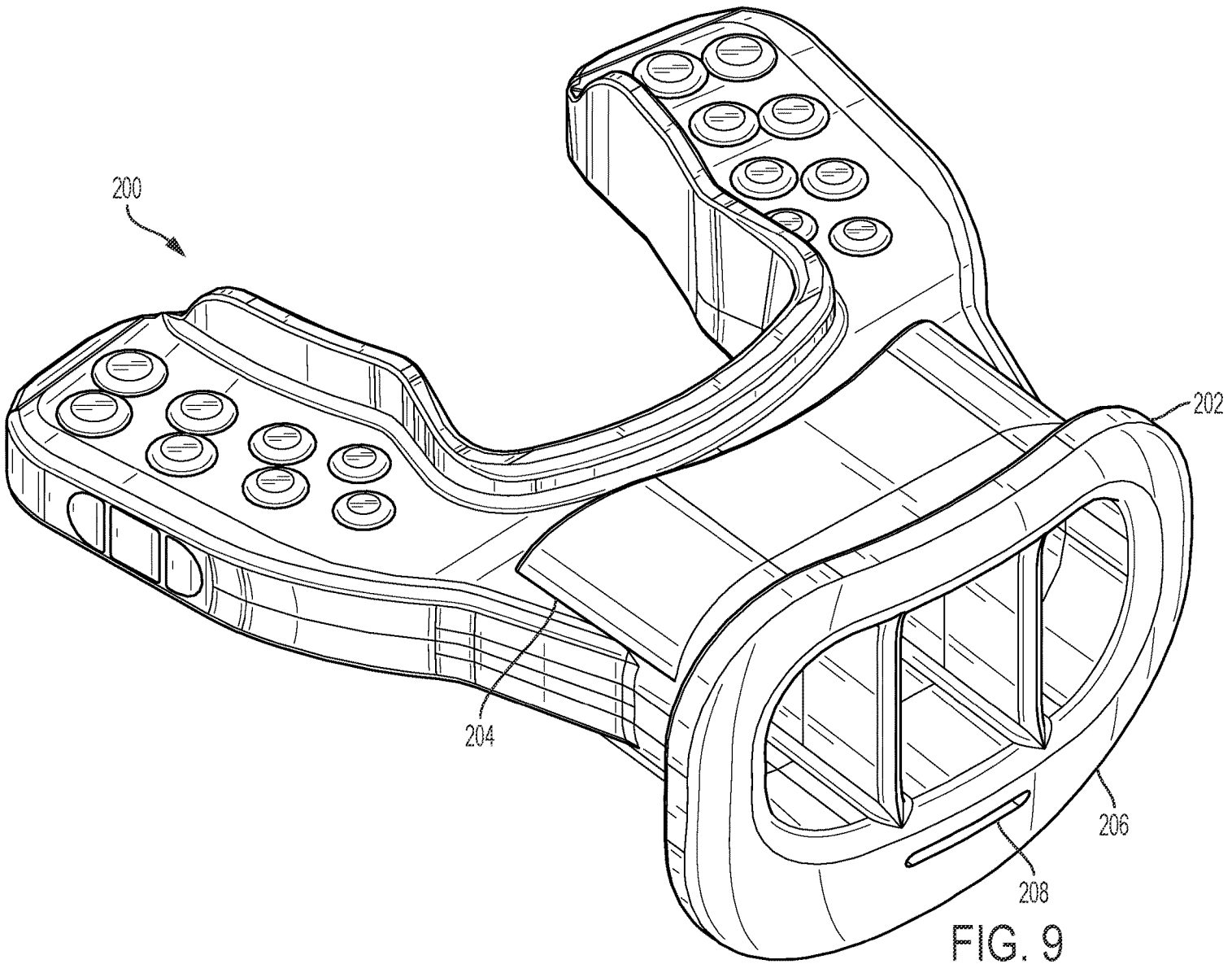
FIG. 9 is a front perspective view of another mouthguard, according to some embodiments.

As described briefly above, the front lip protection portion may have various possible heights and sizes, or may be omitted altogether. FIG. 9 illustrates a mouthguard 200 that is, except as described below, identical to the mouthguard

100 described previously. As shown in FIG. 9, the mouthguard 200 includes, in lieu of the lip protection portion 102 of the mouthguard 100, a low-profile flange 202 located anteriorly relative to the lip engagement portion 204. The flange 202 may be operable to provide structural support to the lip engagement portion 204 but is sized so as not to extend appreciably over the front surface of the wearer's lips when worn.

In the illustrated embodiment, the flange 202 includes a lower extension 206 including a slot 208 for receiving a tether (not shown). In other embodiments, the lower extension 206 and, consequently, the slot 208, are omitted, and the flange has a substantially uniform height about its entire length.

Mouthguards according to some embodiments may lack a front lip protection portion or a flange as described previously. Such mouthguards instead include an anterior surface that defines the opening of the breathing channels (that is, the anterior surface would form the rim of the breathing channels) on a portion of the mouthguard configured to be disposed outside of the wearer's mouth.

Mouthguards according to some embodiments may include additional breathing channels and additional interior walls that are configured to be disposed between other pairs of upper and lower teeth.

Various other modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

The following is claimed:

1. A mouthguard comprising:

a teeth engagement portion comprising a medial surface;

a lip engagement portion coupled to the teeth engagement portion opposite the medial surface, the lip engagement portion comprising a posterior surface;

a front lip protection portion coupled to the lip engagement portion opposite the teeth engagement portion, the front lip protection portion comprising an anterior surface opposite the lip engagement portion and disposed such that the posterior surface is between the anterior surface and the medial surface;

a first breathing channel extending through the lip engagement portion;

a second breathing channel extending through the lip engagement portion;

a third breathing channel extending through the lip engagement portion;

wherein each of the first breathing channel, the second breathing channel, and the third breathing channel comprises:

an anterior opening;

a superior intermediate opening defined at the posterior surface of the lip engagement portion and between the anterior surface and the medial surface;

an inferior intermediate opening defined at the posterior surface of the lip engagement portion and between the anterior surface and the medial surface;

a first interior wall disposed between the first breathing channel and the second breathing channel; and a second interior wall disposed between the second breathing channel and the third breathing channel.

2. The mouthguard of claim 1, wherein each superior intermediate opening is formed at an intersection of a superior surface of the teeth engagement portion and a superior posterior surface of the lip engagement portion, and each inferior intermediate opening is formed at an intersection of an inferior surface of the teeth engagement portion and an inferior posterior surface of the lip engagement portion.

* * * * *